US009061302B1

(12) United States Patent
Peckels

(10) Patent No.: US 9,061,302 B1
(45) Date of Patent: Jun. 23, 2015

(54) LIQUID POURER DEVICE WITH VENTURI EFFECT

(71) Applicant: Arganius E. Peckels, Ogilvie, MN (US)

(72) Inventor: Arganius E. Peckels, Ogilvie, MN (US)

( * ) Notice: Subject to any disclaimer, the term of this patent is extended or adjusted under 35 U.S.C. 154(b) by 0 days.

(21) Appl. No.: 14/260,344

(22) Filed: Apr. 24, 2014

Related U.S. Application Data

(60) Provisional application No. 61/955,377, filed on Mar. 19, 2014.

(51) Int. Cl.
*B05B 1/30* (2006.01)

(52) U.S. Cl.
CPC ..... *B05B 1/302* (2013.01)

(58) Field of Classification Search
USPC ..... 222/481.5, 454, 567, 569, 566, 477, 222/476, 482
See application file for complete search history.

(56) References Cited

U.S. PATENT DOCUMENTS

| | | | | | |
|---|---|---|---|---|---|
| 252,519 | A * | 1/1882 | Righter et al. | ..... | 222/450 |
| 2,642,207 | A * | 6/1953 | Renzi | ..... | 222/479 |
| 4,984,719 | A * | 1/1991 | Brunton | ..... | 222/454 |
| 5,044,521 | A * | 9/1991 | Peckels | ..... | 222/23 |
| 5,961,008 | A * | 10/1999 | Peckels | ..... | 222/477 |
| 6,123,225 | A * | 9/2000 | Peckels | ..... | 222/1 |
| 8,251,262 | B2 * | 8/2012 | Peckels | ..... | 222/476 |
| 2007/0151990 | A1 * | 7/2007 | Garcia | ..... | 222/481.5 |
| 2008/0017675 | A1 * | 1/2008 | Pressey | ..... | 222/481.5 |
| 2009/0179052 | A1 * | 7/2009 | Allen et al. | ..... | 222/479 |

* cited by examiner

*Primary Examiner* — Paul R Durand
*Assistant Examiner* — Donnell Long
(74) *Attorney, Agent, or Firm* — Dave Alan Lingbeck

(57) ABSTRACT

A liquid pourer device with venturi effect for preventing the dripping of liquid from spout after use. The liquid pourer device with venturi effect includes an elongate base member having a bore with a main section and a constricted section and also includes a spout in communication with the elongate base member and further having a flow regulating member movably disposed in the bore.

9 Claims, 4 Drawing Sheets

LIQUID POURER DEVICE WITH VENTURI EFFECT

CROSS-REFERENCE TO RELATED APPLICATIONS

The present application claims the benefit of the U.S. provisional application Ser. No. 61/955,377, filed on Mar. 19, 2014, the disclosure of which is expressly incorporated by reference herein in its entirety.

BACKGROUND OF THE INVENTION

1. Field of the Invention

The present invention relates to liquid pourers and more particularly pertains to a new liquid pourer device with venturi effect for preventing the dripping of liquid from the spout after use.

2. Description of the Prior Art

The use of liquid pourers is known in the prior art. More specifically, liquid pourers heretofore devised and utilized are known to consist basically of familiar, expected and obvious structural configurations, notwithstanding the myriad of designs encompassed by the crowded prior art which have been developed for the fulfillment of countless objectives and requirements.

The prior art includes molded one-piece liquid pourers with uniform bores and passageways for dispensing liquids therethrough from containers. While these devices fulfill their respective, particular objectives and requirements, the aforementioned patents do not disclose a new liquid pourer device with venturi effect.

SUMMARY OF THE INVENTION

The general purpose of the present invention, which will be described subsequently in greater detail, is to provide a new liquid pourer device with venturi effect which has many of the advantages of the liquid pourers mentioned heretofore and many novel features that result in a new liquid pourer device with venturi effect which is not anticipated, rendered obvious, suggested, or even implied by any of the prior art liquid pourers, either alone or in any combination thereof. The present invention includes a elongate base member having a bore with a main section and a constricted section and also includes a spout in communication with the elongate base member and further having a flow regulating member movably disposed in the bore. None of the prior art includes the combination of the elements of the present invention.

There has thus been outlined, rather broadly, the more important features of the liquid pourer device with venturi effect in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new liquid pourer device with venturi effect which has many of the advantages of the liquid pourers mentioned heretofore and many novel features that result in a new liquid pourer device with venturi effect which is not anticipated, rendered obvious, suggested, or even implied by any of the prior art liquid pourers, either alone or in any combination thereof.

Still another object of the present invention is to provide a new liquid pourer device with venturi effect for preventing the dripping of liquid from the spout after stopping the dispensing of the liquid from the bottle.

Still yet another object of the present invention is to provide a new liquid pourer device with venturi effect that retains liquid in the spout upon the flow regulating member shutting off the dispensation of liquid from the bottle.

Even still another object of the present invention is to provide a new liquid pourer device with venturi effect that suspends the liquid in the spout after the flow regulating member becomes seated in the seat section.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
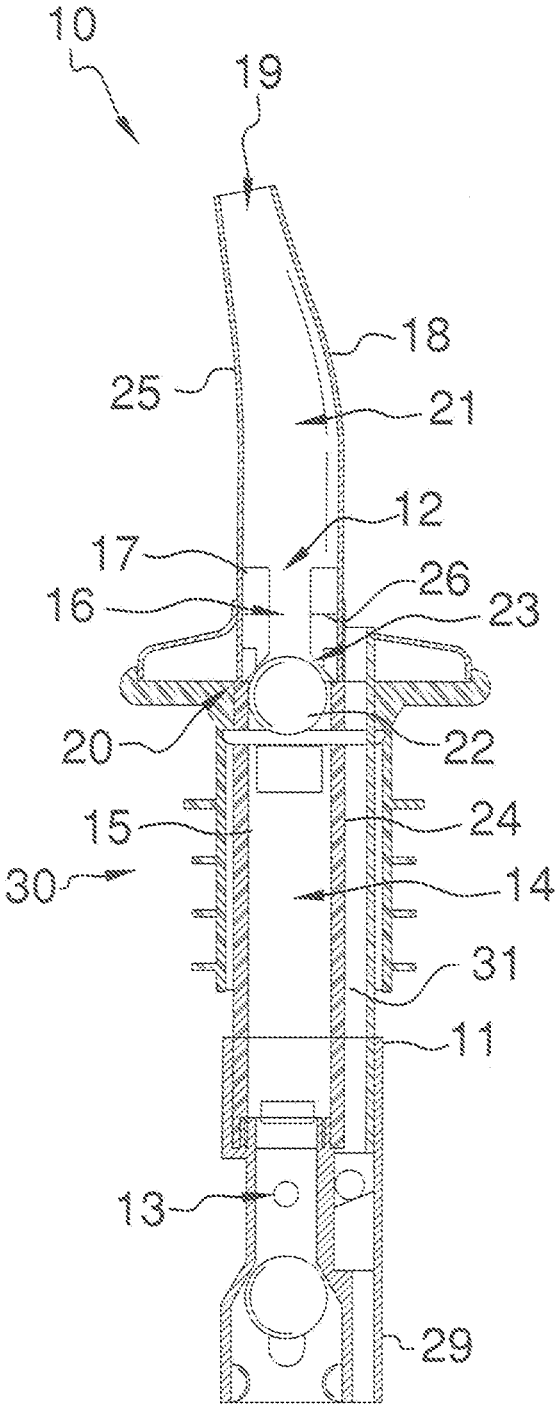
FIG. 1 is a side longitudinal cross-sectional view of a new liquid pourer device with venturi effect according to the present invention.

With reference now to the drawings, and in particular to FIGS. 1 through 4, a new liquid pourer device with venturi effect embodying the principles and concepts of the present invention and generally designated by the reference numeral 10 will be described.

As best illustrated in FIGS. 1 through 4, the liquid pourer device with venturi effect 10 may generally comprise a pourer assembly 30 adapted to be at least partially inserted in an opening of a bottle 27 containing liquid 30, and including an elongate base member 11 made of plastic or any other suitable material and having a wall 24, an open front end 12, an opening 13 near a back end 29 and further having a bore 14 extending therethrough in fluid communication with the open front end 12 and the opening 13 near the back end 29 of the elongate base member 11. The bore 14 in the elongate base member 11 may also include a main section 15 and a constricted section 16 forward of the main section 15 at the open front end 12 with the cross-sectional area of the constricted section 16 being smaller than that of the main section 15. Interconnecting the constricted section 16 with the main section 15 is a seat section 23. The seat section 23 is tapered outwardly towards the main section 15 of the bore 14. The elongate base member 11 may have a front end portion 26, wherein the constricted section 16 has a length and forms the front end portion 26 of the elongate base member 11. In addition, the elongate base member 11 may have a vent 31 extending the length of the elongate base member to allow air into the bottle 27 to facilitate the pouring of the liquid 28 from the bottle 27 through the pourer assembly 30.

An annular support member 17 may be disposed about an exterior of the wall 24 of the front end portion 26 at the open front end 12 of the elongate base member 11. A flow regulating member 22 such as a ball bearing and made of any suitable material may be movably disposed in the bore 14 of the elongate base member 11 and may move from the opening 13 near the back end 29 to the seat section 23 upon liquid being dispensed through the liquid pourer device 10 and then may move back to near the opening 13 near the back end 29 of the elongate base member 11 when the bottle is poised in a non-dispensing position. A spout 18 made of chrome plating or any other suitable material may be integrally connected to or securely engaged with the elongate base member 11 with the spout 18 having a wall 24, an open back end 20 and an open front end 19 with a passageway 21 extending therethrough in communication with the open back and front ends 19, 20 of the spout 18 and with the bore 14 of the elongate base member 11. The annular support member 17 and the constricted section 16 of the bore 14 are securely disposed and conventionally engaged in the passageway 21 of the spout 18 through the open back end 20 with the passageway 21 having a larger cross-sectional area than that of the constricted section 16 and with the annular support member 17 engaged with the wall forming the passageway 21 to secure the spout 18 to the elongate base member 11.

Figure 2:
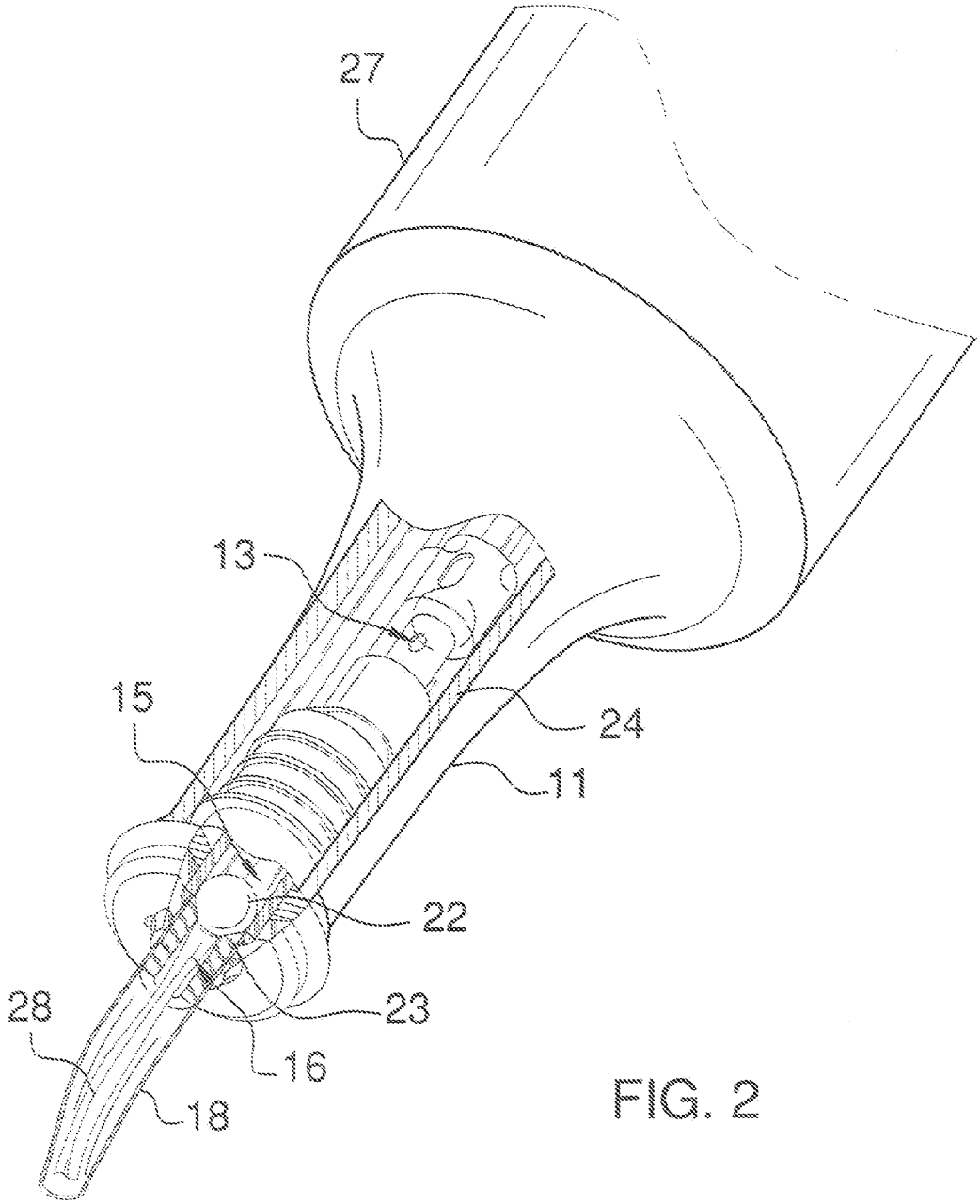
FIG. 2 is a perspective view of the bottle pourer in a bottle with the bottle being tipped for pouring with the liquid being retained in the spout upon the flow regulating member being seated in the seat section.
Figure 3:
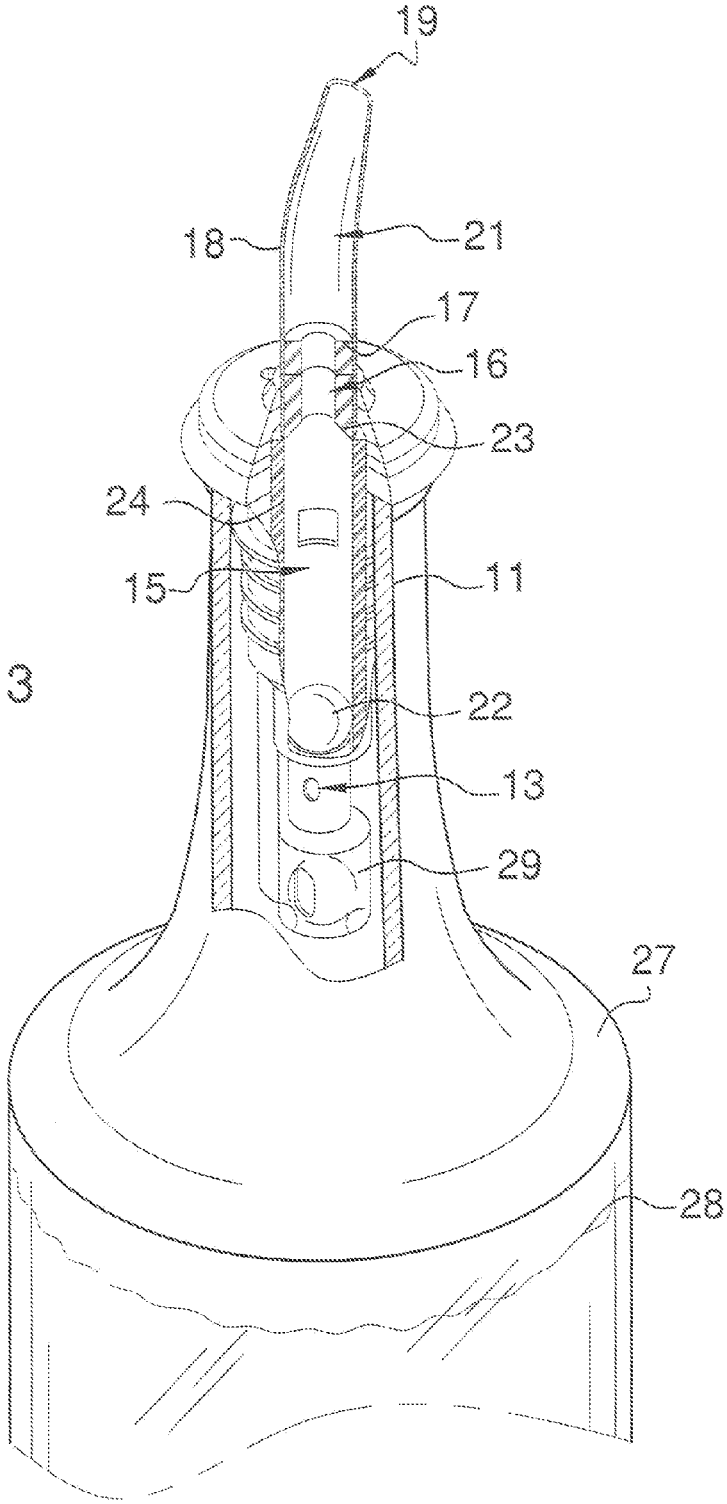
FIG. 3 is a perspective view of the bottle pourer in a bottle with the bottle with the flow regulating member removed from the seat section and moved to the back end of the elongate base member.
Figure 4:
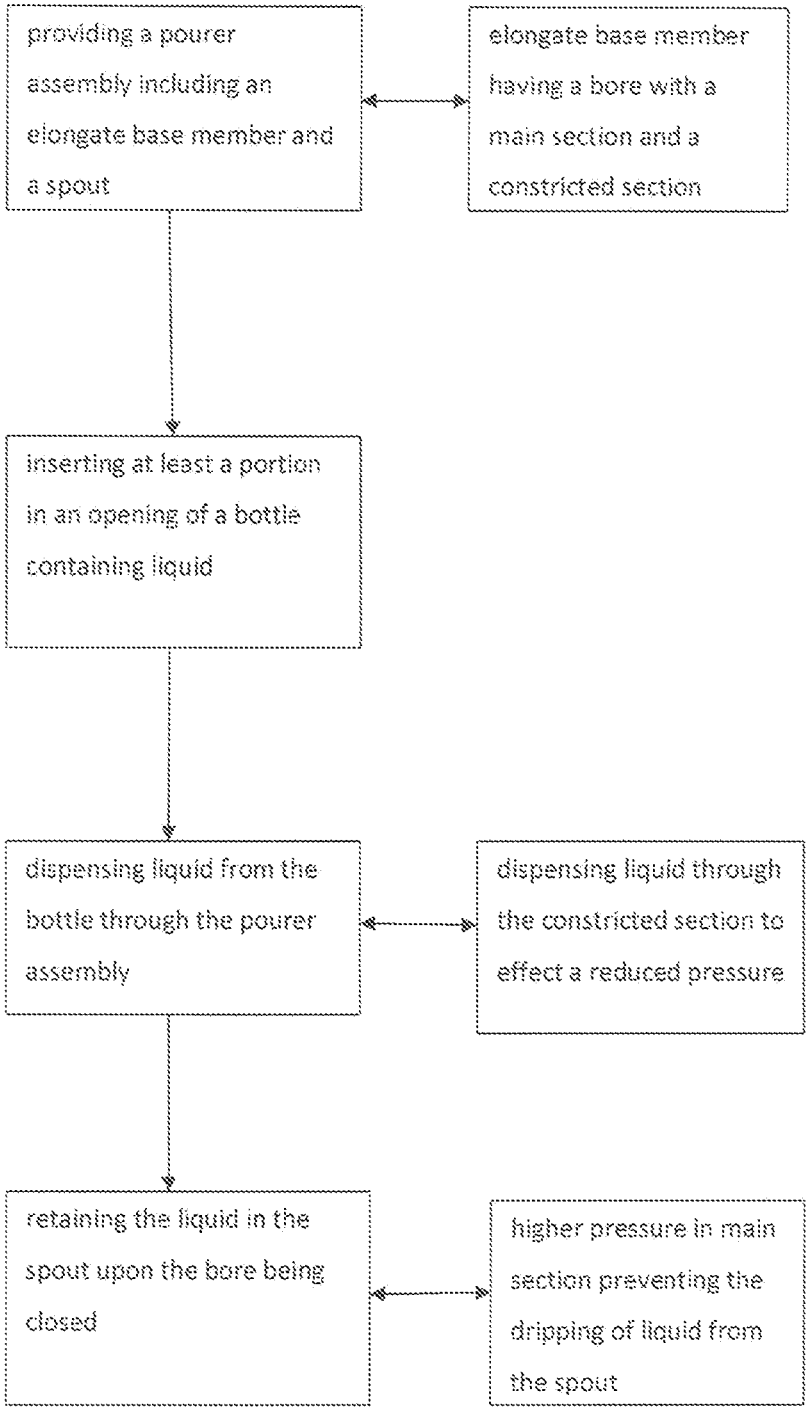
FIG. 4 is a block diagram of the method of using the liquid pourer device with venturi effect.

As shown in FIG. 4, as liquid 28 is dispensed from the bottle 27 through the liquid pourer device 10, the flow regulating member 22 moves in the bore 14 of the elongate base member 11 from near the back end 29 to the seat section 23 as pressure in the constricted section 16 of the bore 14 decreases. Only a selected or measured amount of liquid 28 is dispensed from the liquid pourer device 10 as the flow regulating member 22 moves in the bore 14 and becomes seated in the seat section 23 to prevent the liquid 28 in the spout 18 from dripping out the open front end 19 of the spout 18. The velocity of the liquid 28 passing through the constricted section 16 increases, and the pressure in the constricted section 23 decreases to less than the pressure in the main section 15 of the bore 14 behind the constricted section 16. The higher pressure in the main section 15 of the bore 14 prevents the liquid in the spout 18 from dripping with that liquid 28 being retained in the passageway 21 of the spout 18 upon the flow regulating member 22 being seated in the seat section 23 to shut off the liquid being dispensed from the bottle 27 so that no liquid 28 as shown in FIG. 2 drips out the open front end 19 of the spout 18 and onto the user's hand or on the outside of the spout 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the liquid pourer device with venturi effect. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liquid pourer device with venturi effect comprising:

a pourer assembly adapted to be in fluid communication with a bottle and including an elongate base member having a wall, an open front end, an opening near a back end, and a bore extending therethrough, and also including a spout in fluid communication with the elongate base member and having a wall, an open front end, an open back end, and a passageway extending therethrough in communication with the bore, wherein the bore of the elongate base member has a main section and a constricted section having a cross-sectional area smaller than that of the main section and effecting a pressure differential between the constricted section and the main section of the bore with the pressure through the dispensed therethrough to effectively retain the liquid in the passageway of the spout upon the bore being closed, wherein the elongate base member has a front end portion, wherein the constricted section has a length and is disposed at the open front end and forms the front end portion of the elongate base member.

2. The liquid pourer device with venturi effect as described in claim 1, wherein the front end portion of the elongate base member extends into the passageway of the spout.

3. The liquid pourer device with venturi effect as described in claim 1, wherein the pourer assembly further includes a support member attached to the front end portion of the elongate base member and engagable in the passageway of the spout.

4. The liquid pourer device with venturi effect as described in claim 3, wherein the support member is disposed about the front end portion of the elongate base member and attached to an exterior of the wall and proximate to the open front end of the elongate base member.

5. A liquid pourer device with venturi effect comprising:

a pourer assembly adapted to be in fluid communication with a bottle and including an elongate base member having a wall, an open front end, an opening near a back end, and a bore extending therethrough, and also including a spout in fluid communication with the elongate base member and having a wall, an open front end, an open back end, and a passageway extending therethrough in communication with the bore, wherein the bore of the elongate base member has a main section and a constricted section having a cross-sectional area smaller than that of the main section and effecting a pressure differential between the constricted section and the main section of the bore with the pressure through the constricted section being less than that of the main section as liquid is being dispensed therethrough to effectively retain the liquid in the passageway of the spout upon the bore being closed, wherein the pourer assembly further includes a seat section disposed in the bore at a back end of the constricted section and interconnecting the constricted section to the main section of the elongate base member.

6. The liquid pourer device with venturi effect as described in claim 5, wherein the wall of the bore of the elongate base member is tapered outwardly from the constricted section to the main section to form the seat section.

7. The liquid pourer device with venturi effect as described in claim 5, wherein the pourer assembly also includes a flow regulating member to effectively measure the amount of the liquid being dispensed through the pourer assembly from the bottle; wherein the flow regulating member is movably disposed in the bore.

8. The liquid pourer device with venturi effect as described in claim 7, wherein the flow regulating member moves and becomes seated in the seat section to close the bore and to shut off dispensing of the liquid from the bottle and to prevent the liquid in the spout from dripping out the open front end of the spout.

9. The liquid pourer device with venturi effect as described in claim 8, wherein the flow regulating member is removed from the seat section and moves to near the back end of the bore when the pourer assembly is in a non-dispensing position.

* * * * *